United States Patent [19]

Yamashita et al.

[11] Patent Number: 4,669,717

[45] Date of Patent: Jun. 2, 1987

[54] RECORDING APPARATUS

[75] Inventors: Mitsuo Yamashita, Tokyo; Kiyoshi Tomimori; Jiro Egawa, both of Yokohama, all of Japan

[73] Assignee: Kabushiki Kaisha Toshiba, Kawasaki, Japan

[21] Appl. No.: 732,142

[22] Filed: May 9, 1985

[30] Foreign Application Priority Data

May 11, 1984 [JP] Japan ..... 59-94222

[51] Int. Cl.[4] ..... B65H 29/00

[52] U.S. Cl. ..... 271/186; 271/3.1; 271/213; 271/286; 271/291

[58] Field of Search ..... 271/186, 3.1, 285, 286, 271/291, 301, 213

[56] References Cited

U.S. PATENT DOCUMENTS

| | | | |
|---|---|---|---|
| 3,856,295 | 12/1974 | Looney | 271/65 |
| 3,964,741 | 6/1976 | Kroeker | 271/213 |
| 4,133,522 | 1/1979 | Siegl | 271/291 |
| 4,191,369 | 3/1980 | Matsuda | 271/186 X |
| 4,269,406 | 5/1981 | Hamlin | 271/3.1 X |

FOREIGN PATENT DOCUMENTS 54-41732 4/1979 Japan .

*Primary Examiner*—Richard A. Schacher

*Attorney, Agent, or Firm*—Schwartz, Jeffery, Schwaab, Mack, Blumenthal & Evans

[57] ABSTRACT

A recording apparatus records an image impression of an original on a sheet. The recording apparatus comprises a flip lever arranged to oppose a distal end of a first convey path for conveying the sheet recorded by a recording mechanism. The flip lever is movable between the first position where the sheet conveyed along the first convey path is guided in a second convey path and a second position where the sheet is guided in a third convey path. A temporary stacking tray is arranged to oppose a distal end of the second convey path and temporarily stacks the sheet guided by the flip lever from the first convey path to the second convey path while the first surface of the sheet faces upward. In front of the temporary stacking tray, an inverting mechanism is provided for conveying the sheet temporarily stacked on the temporary stacking tray to the third convey path through a fourth convey path without passing through the flip lever while the second surface opposing the first surface faces upward.

12 Claims, 11 Drawing Figures

RECORDING APPARATUS

BACKGROUND OF THE INVENTION

The present invention relates to an image forming apparatus such as a copying apparatus or an electronic printer for forming an image on a recording medium and, more particularly, to an image forming apparatus with a stacking apparatus for stacking an exhausted recording medium with images thereon.

In a conventional copying apparatus, as shown in FIG. 1, a sheet P is supplied from a paper cassette 1 to an image forming section, and an image is transferred to the sheet P. The sheet P is then discharged from an discharge port 2 and stacked on a tray 3.

The sheet P is discharged on the tray 3 such that an image formation surface P' of the sheet P faces upward so as to allow an operator to see the formed image.

When the discharged sheets P are stacked on the tray 3 while the image formation surfaces P' thereof face upward, the order of sheets P is reversed at the end of the copying operation. In other words, the uppermost image corresponds to the last document image. In order to rearrange the sheets P in the same order as that of the document images, the stacked sheets P must be reversed in order again, resulting in a cumbersome operation.

In addition, when each of a plurality of documents is to be copied a plurality of times, a plurality of copied sheets are stacked on the tray 3 in units of documents. In this case, the boundary between a plurality of copied sheets for a given document and those for a document next to the given document cannot be easily identified. For this reason, a sorting/stacking apparatus called a sorter is proposed. When a copying apparatus has a sorter, the overall size is increased at high cost.

SUMMARY OF THE INVENTION

The present invention has been made in consideration of the above situation, and has as its object to provide a recording apparatus with a stacking apparatus, wherein storing of the copied sheets discharged on a discharge tray can be automatically performed with a simple arrangement.

According to one aspect of the present invention, there is provided a recording apparatus which records information on a sheet-like recording medium having a first surface and a second surface opposing the first surface, comprising recording means for recording the information on the first surface while the first surface of the recording medium faces upward, conveying means for conveying the recording medium having the information recorded by said recording means along a first convey path while the first surface faces upward, switching means arranged to oppose a distal end of the first convey path and movable between a first position where the recording medium conveyed along the first convey path is guided in a second convey path and a second position where the recording medium is guided in a third convey path, a temporary stacking tray, arranged to oppose a distal end of the second convey path, for temporarily stacking the recording medium guided by said switching means from the first convey path to the second convey path while the first surface faces upward, said temporary stacking tray having a temporary stacking surface which is closed to the external atmosphere, a stacking tray, arranged at a distal end of the third convey path, for stacking the recording medium guided along the third convey path, said stacking tray having a stacking surface open to the external atmosphere, and inverting means for conveying the recording medium temporarily stacked on said temporary stacking tray to the third convey path through a fourth convey path without passing through said switching means while the second surface faces upward.

BRIEF DESCRIPTION OF THE DRAWINGS

FIGS. 2 to 9 show a recording apparatus according to an embodiment of the present invention, in which FIG. 2 is a side view of a copying apparatus as the recording apparatus, FIG. 3 is a side view schematically showing an inversion mechanism of a stacking apparatus attached to the copying apparatus, FIG. 4 is a partial cutaway front view of a variable mechanism of the stacking apparatus, FIG. 5 is a side sectional view of the variable mechanism, FIG. 6 is a side view showing a drive system for the inversion and variable mechanisms, FIG. 7 is a block diagram of a control system of the stacking apparatus, FIG. 9 is a side view schematically showing the non-inversion operation.

DETAILED DESCRIPTION OF THE PREFERRED EMBODIMENT

A recording apparatus according to an embodiment of the present invention will be described in detail with reference to FIGS. 2 to 9 wherein the present invention is applied to a copying apparatus.

Figure 1:
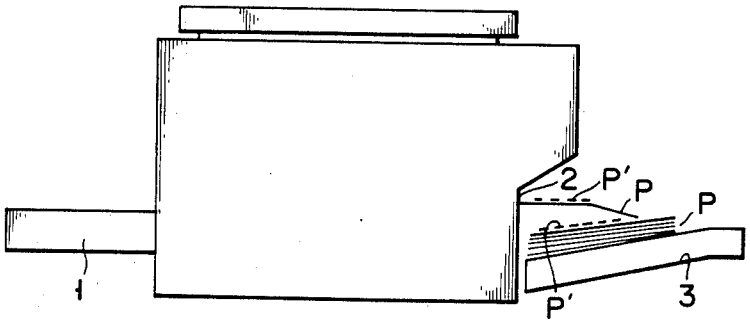
FIG. 1 PRIOR ART
FIG. 1 is a side view showing a conventional copying apparatus.
Figure 2:
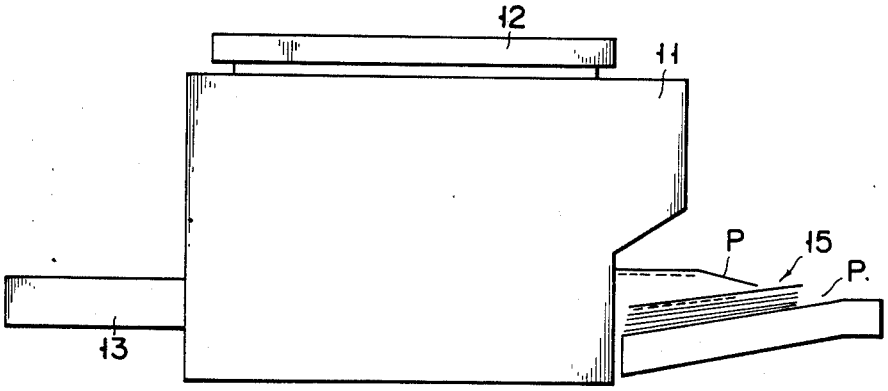
Figure 3:
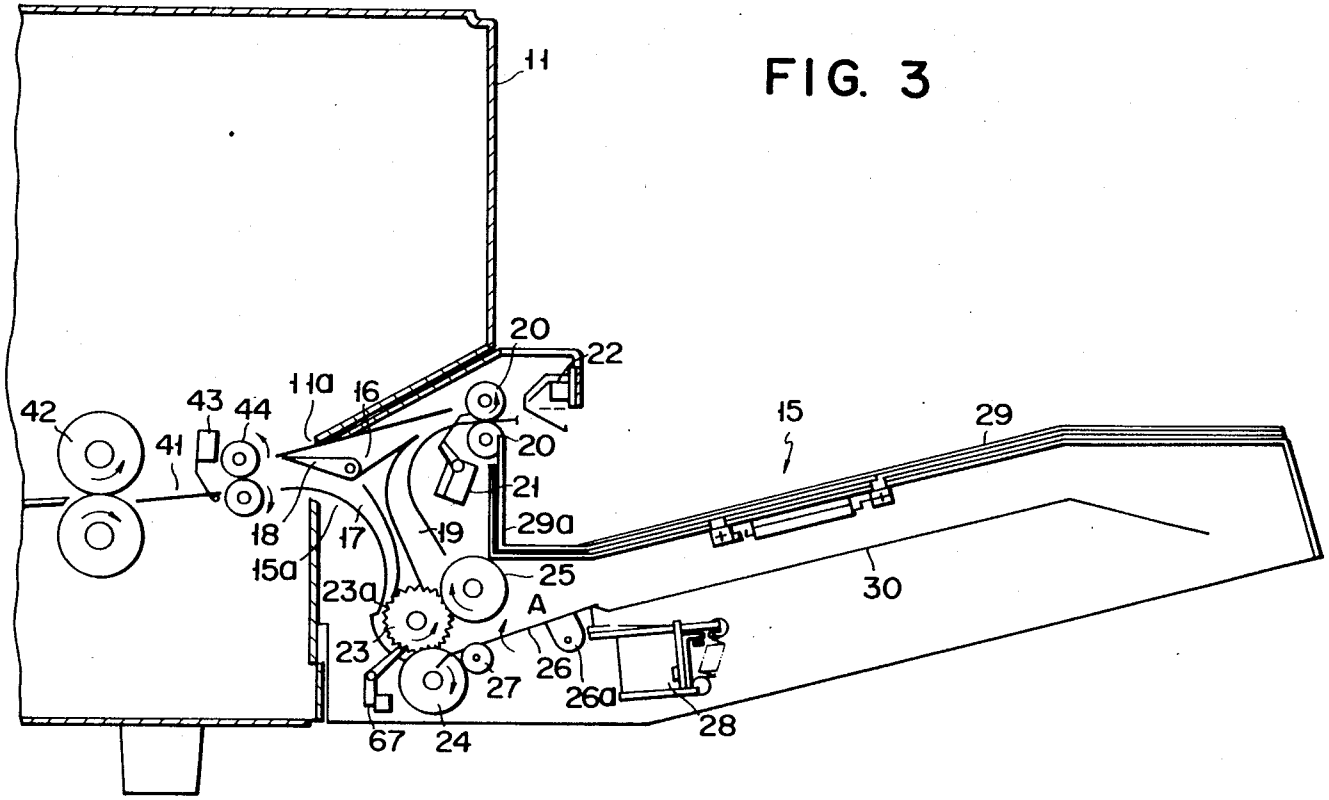

Referring to FIG. 2, reference numeral 11 denotes the housing of an electronic copying apparatus. A document table 12 is arranged at the upper portion of the housing 11. A paper cassette 13 is detachably mounted on a lower portion of one side wall of the housing 11 to feed sheets P as a recording medium. A stacking apparatus 15 is detachably mounted on the other side wall of the housing 11 to stack the discharged sheets P, as shown in FIG. 3. An image forming section 14 is formed in the housing 11 although detail of the section 14 is not illustrated. The image formation section 14 comprises: a photosensitive drum 14*a;* a charger 14*b,* an exposure unit 14*c,* a developing unit 14*d,* a transfer unit 14*e,* a separation unit 14*f* and a cleaning unit 14*g* which are arranged to surround the drum 14*a;* a fixing unit 14*h* for fixing a toner image transferred by the transfer unit 14*e* to the sheet P; and a convey unit 14*i* for picking up the sheet P from the cassette 13 and conveying the sheet P to the stacking apparatus 15 through the units 14*e* and 14*h.* Thereafter, an image is transferred from the drum 14*a* to the sheet P supplied from the cassette 13, and the sheet P is then conveyed in the stacking apparatus 15.

The stacking apparatus 15 has the arrangement shown in FIGS. 3 to 6. The apparatus 15 has a port 15*a* communicating with a discharge port ll*a* of the housing 11. The apparatus 15 also has first to third convey paths 16, 17 and 19. The proximal end portions of the paths 16 and 17 are located near the port 15*a* and are selectively closed by a flip lever 18. The lever 18 can be actuated by a flip lever solenoid 78, as shown in FIG. 7. The paths 16 and 17 are coupled to each other through the path 19.

A pair of exhaust rollers 20 are on the end portion of the path 16. A discharged sheet detection switch 21 is set on the feed side of the rollers 20. A full detection switch 22 is set on the delivery side of the rollers 20. A convey roller 23 with a plurality of meshing grooves 23*a* thereon is arranged at the end portion of the path 17. A first bracing roller 24 is in rolling contact with the lower portion of the roller 23. Similarly, a second bracing roller 25 is in rolling contact with the upper portion of the roller 23. An inversion detection switch 67 is arranged at the feed side of the roller 23. An inversion plate 26 is pivotally mounted about a pivot pin 26*a* at the delivery side of the roller 23 so as to constitute an inversion mechanism A. An inversion plate roller 27 is integrally mounted at the pivotal end of the plate 26. The plate 26 is actuated by an inversion solenoid 28 to be brought into contact with or separated from the roller 25.

A discharge path 41 is formed in the housing 11 so as to deliver the sheet P with a fixed image to the stacking apparatus 15. A pair of feed rollers 42, an outlet switch 43 and a pair of discharge rollers 44 are arranged sequentially along the sheet feed direction of the path 41. The rollers 44 oppose the port 11*a*.

The apparatus 15 has a discharge tray 29 for receiving the sheet P discharged from the path 16. The tray 29 extends obliquely upward from the housing 11. A vertical portion 29*a* is integrally formed with the front end portion of the tray 29. A subtray 30 is arranged below the tray 29 to be parallel therewith.

Figure 4:
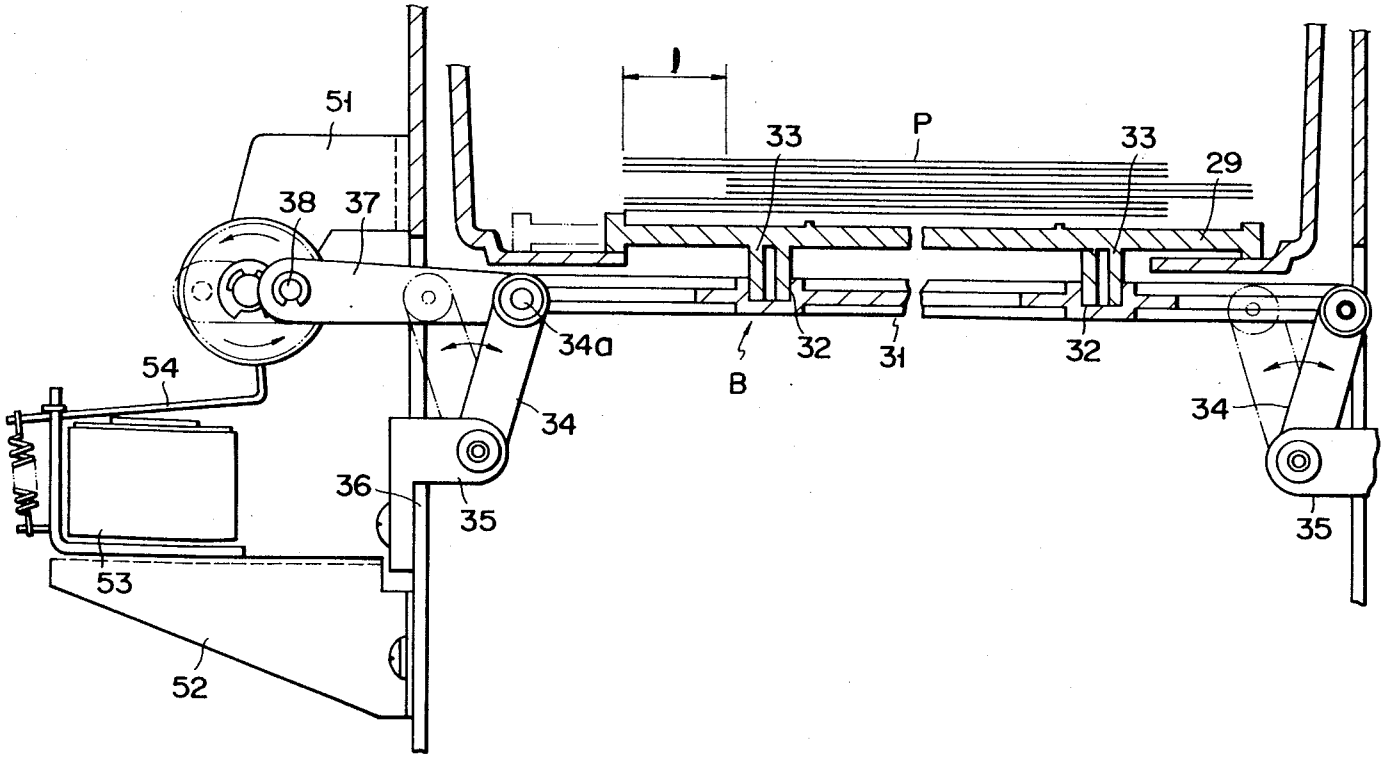
Figure 5:
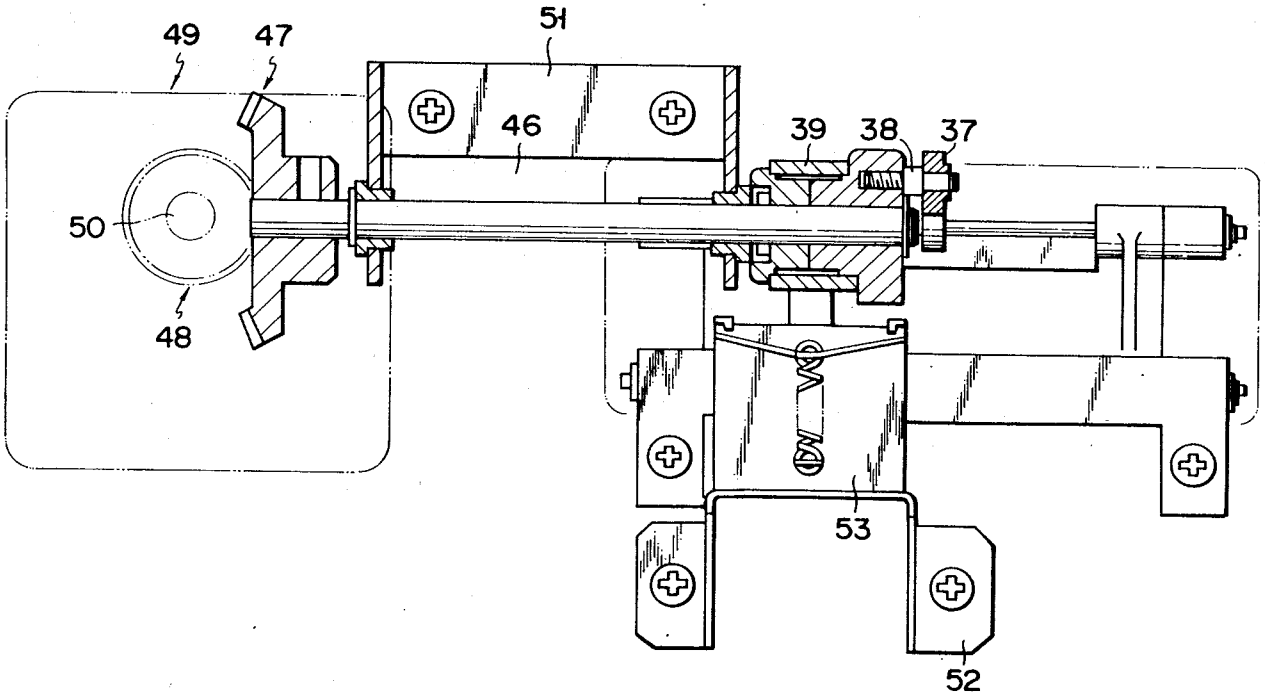

As shown in FIG. 4, the tray 29 is placed on an upper surface of a slider 31 which constitutes a variable mechanism B. A pair of engaging recesses 32 are formed in the upper surface of the slider 31. A pair of projections 33 extending from the bottom surface of the tray 29 can be engaged with the recesses 32, respectively. In other words, the tray 29 can be detachably mounted on the slider 31. Two sides of the slider 31 are supported by a frame 36 through pivot links 34 and brackets 35. One end of a connecting rod 37 is connected to one of the links 34 through a link pin 34*a*. A half-rotatable spring clutch 39 is connected to the other end of the rod 37 through a crank pin 38. The pins 34*a* and 38 and the rod 37 constitute a crank mechanism. An output shaft 50 of a motor 49 is connected to the clutch 39 through a drive shaft 46 and bevel gears 47 and 48, as shown in FIG. 5.

The shaft 46 is held by the frame 36 through a bracket 51. A solenoid 53 is supported by a bracket 52 and arranged below the clutch 39. The clutch 39 is stopped by a lever 54 of the solenoid 53 every time the clutch 39 is rotated by a half revolution.

Figure 6:
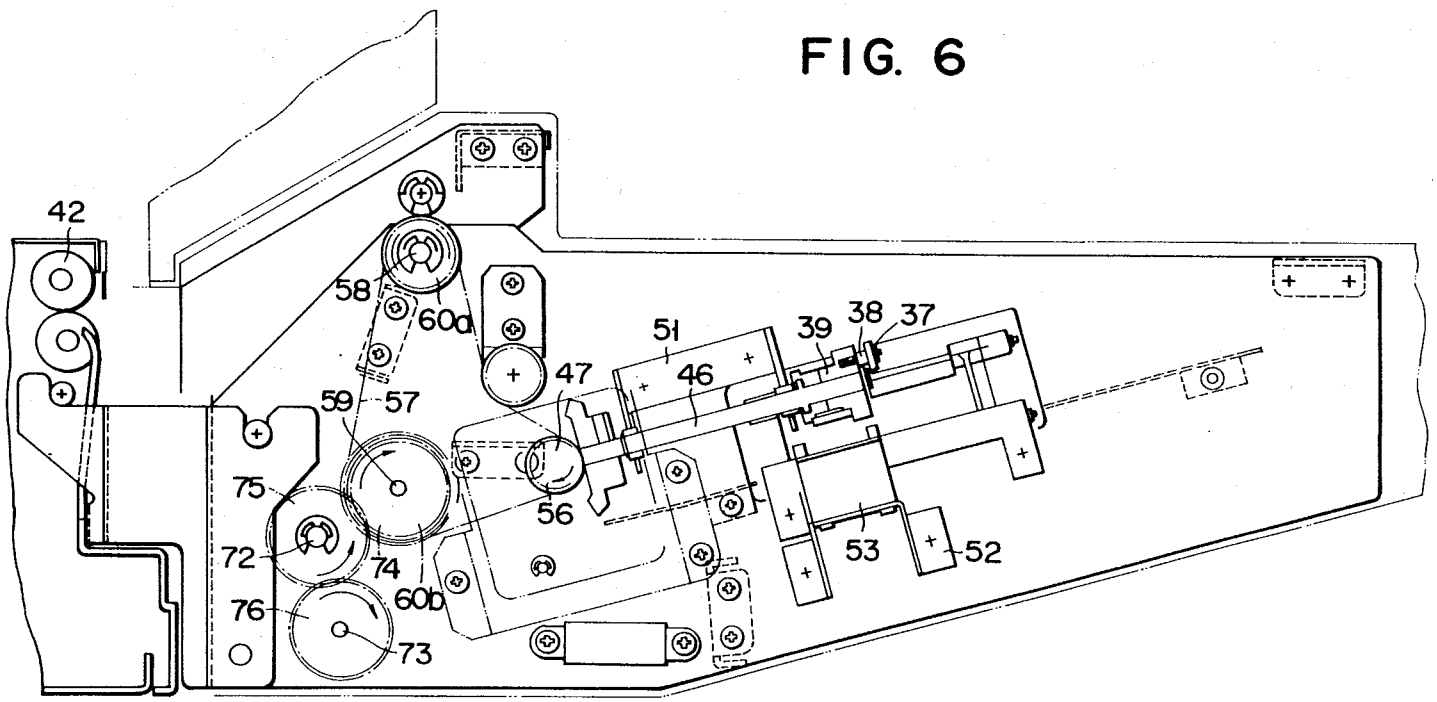
Figure 7:
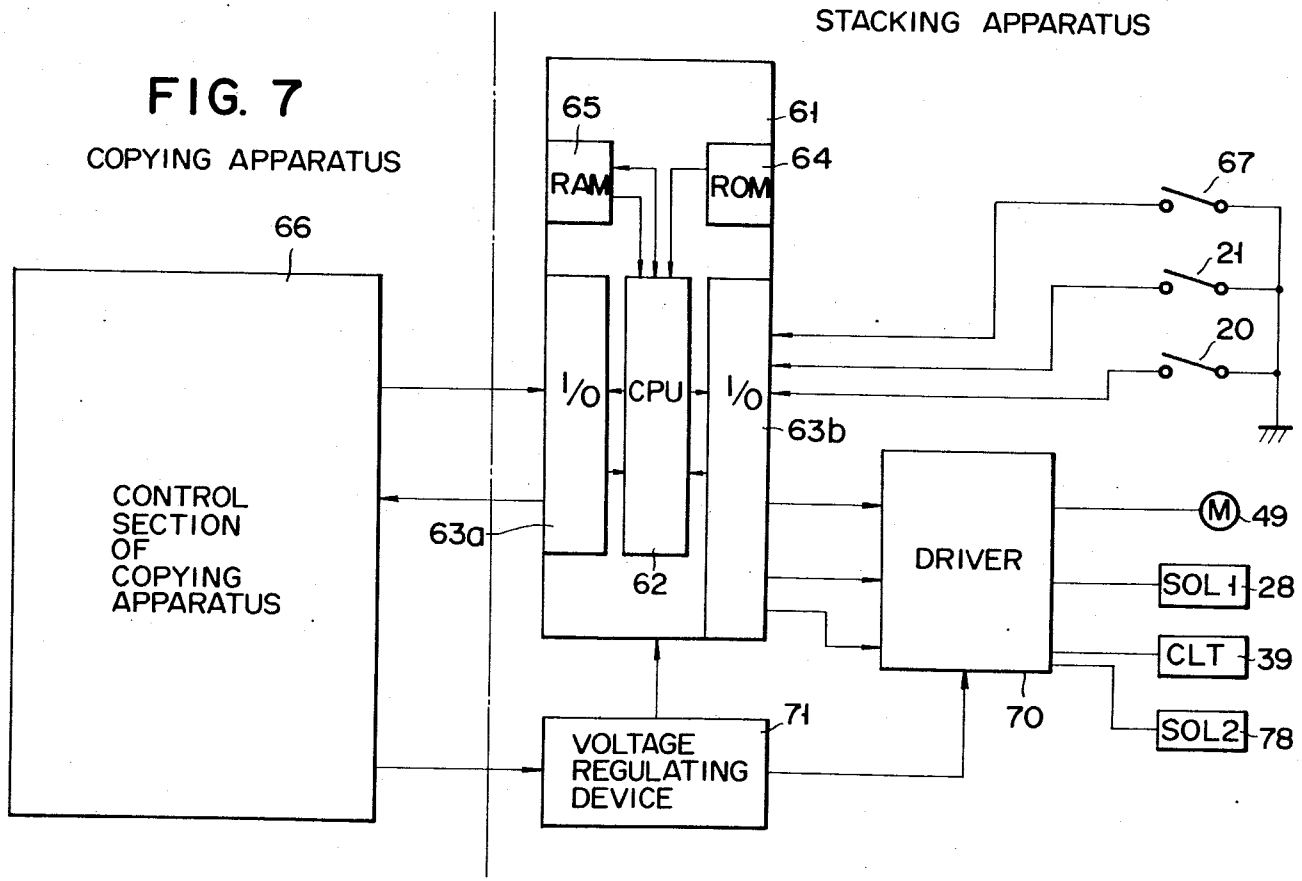

A sprocket 56 is mounted on the shaft 50 of the motor 49, as shown in FIG. 6. The sprocket 56 is coupled to sprockets 60*a* and 60*b* respectively mounted on shafts 58 and 59 of the rollers 20 and 25 through a chain 57. A gear 74 is mounted on the shaft 59 of the roller 25. The gear 74 meshes with a gear 76 mounted on a shaft 73 of the roller 24 through a gear 75 mounted on a shaft 72 of the roller 23. In this manner, the inversion and variable mechanisms A and B are driven by the common motor 49.

The stacking apparatus 15 is controlled by a control system shown in FIG. 7. Referring to FIG. 7, reference numeral 61 denotes a microcomputer. The microcomputer 61 comprises a central processing unit (CPU) 62, I/0 ports 63*a* and 63*b*, a program control ROM 64 and a data storage RAM 65. The CPU 62 is connected to a section 66 of the copying apparatus through the port 63*a*. The CPU 62 is also connected to the switches 67, 21 and 22 through the port 63*b*. In addition, the CPU 62 is connected to a driver 70 through the port 63*b*. The motor 49, the solenoid 28, the clutch 39 and the solenoid 78 are actuated through the driver 70. It should be noted that reference numeral 71 denotes a voltage regulating device.

With the above arrangement, a single copying mode wherein each of a plurality of documents is copied once will be described. In the single copying mode, the sheet P with an image is conveyed along the path 41 in the housing 11. When the sheet P passes by the switch 43, the switch 43 arranged near the outlet of the path 41 is turned on. Upon the ON operation of the switch 43, an output signal is generated from the section 66 of the copying apparatus. This signal is transferred to the CPU 62 through the port 63*a*. The CPU 62 causes the driver 70 to operate the driver 70 through the port 63*b*, thereby actuating the solenoid 78. At the same time, the motor 49 in the tray 29 is started. The lever 18 is pivoted upward upon operation of the solenoid 78. The motor 49 drives the rollers 23, 24 and 25 and the rollers 20 through the chain 57.

Figure 8A:
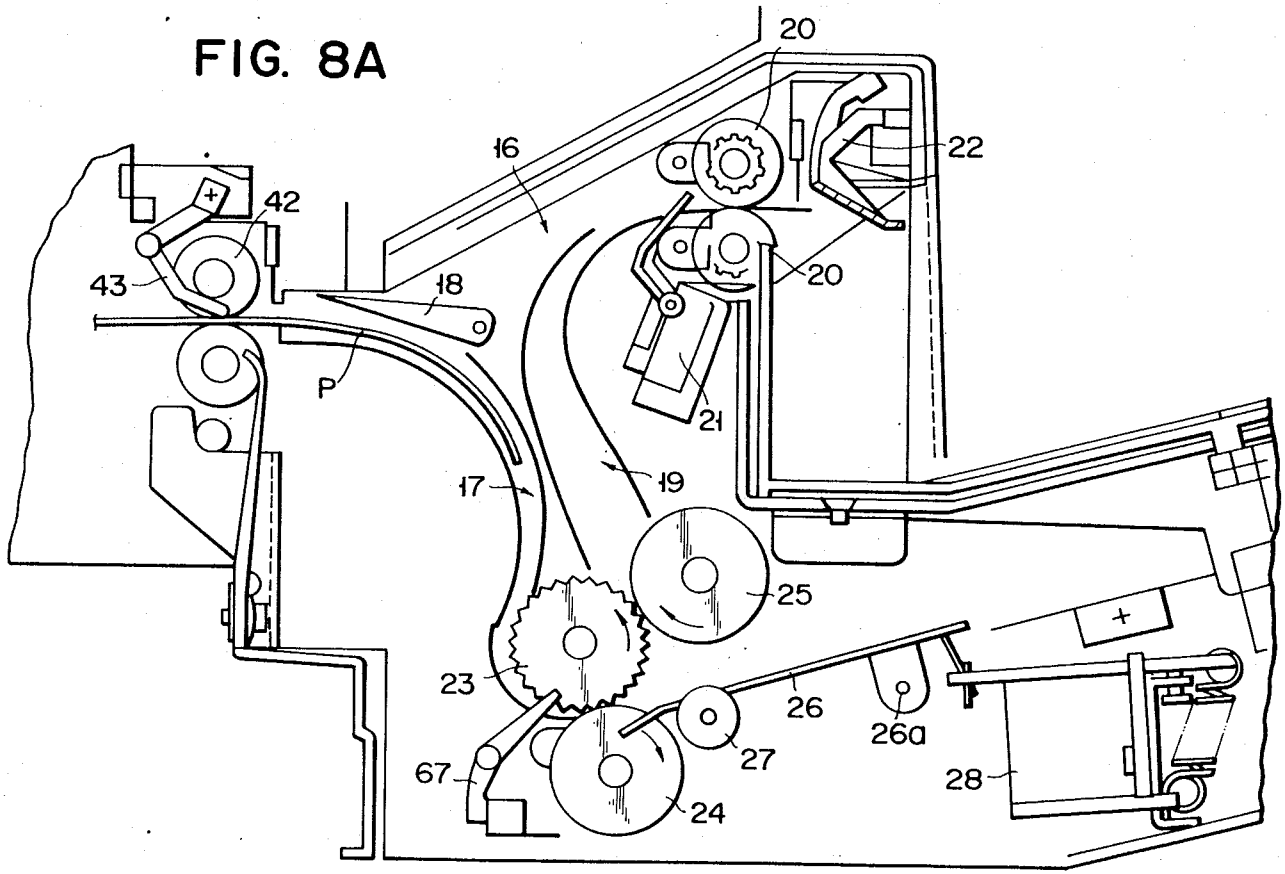
FIGS. 8A to 8C are respectively side views schematically showing the inversion operation.
Figure 8B:
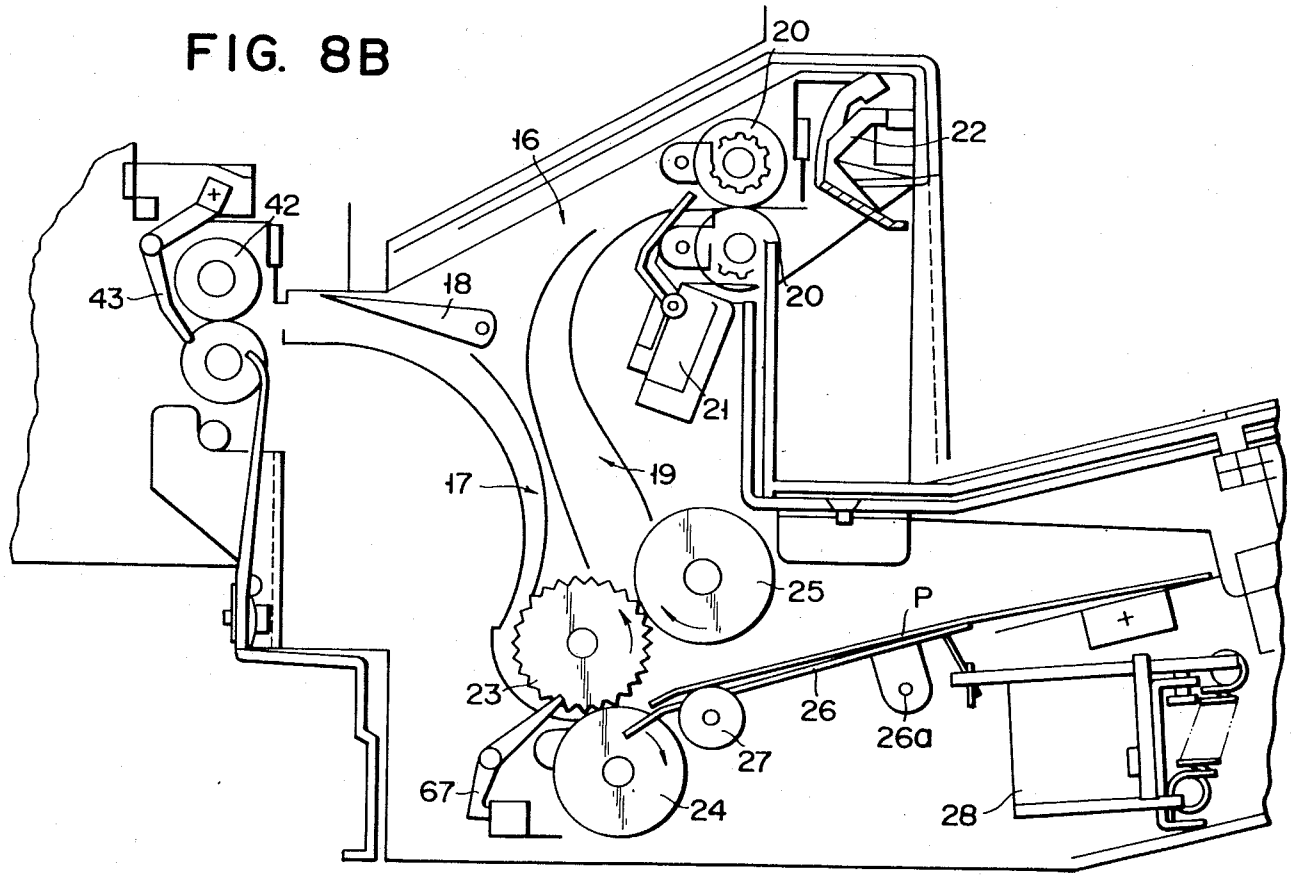
Figure 8C:
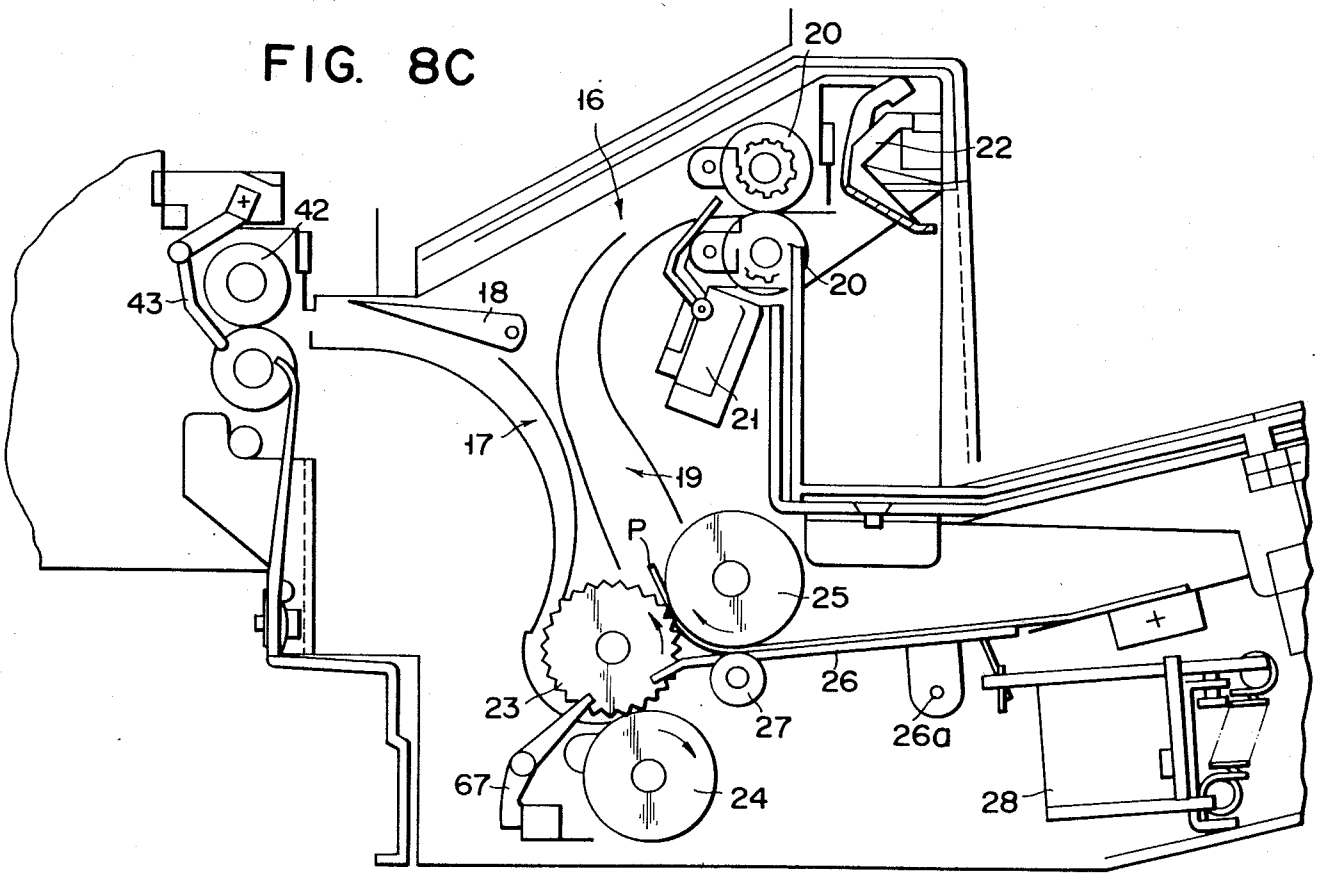

In this state, the sheet P is discharged by the rollers 42, as shown in FIG. 8A and is conveyed in the path 17 since the lever 18 is pivoted upward. The switch 67 detects that the sheet P is fed in the path 17. A detection signal from the switch 67 is supplied to the CPU 62 through the port 63*b*. The CPU 62 counts a predetermined period of time (a time from which the trailing end of the sheet P is detected until the trailing end of the sheet P is separated from the roller 23). As shown in FIG. 8B, the CPU 62 stops counting the predetermined period of time and supplies a signal to the driver 70 which then drives the solenoid 28. Upon operation of the solenoid 28, the plate 26 is pivoted about the pin 26*a* in the direction of the arrow. As shown in FIG. 8C, the roller 27 at the distal end of the plate 26 is brought into rolling contact with the roller 25, thereby moving upward the trailing end of the sheet P on the plate 26. In this manner, the sheet P is inserted between the rollers 23 and 25. The solenoid 28 is held operative for a predetermined period of time. Thereafter, the solenoid 28 is deenergized in response to a signal from the CPU 62 so that the plate 26 is pivoted downward, thereby obtaining the initial state. The holding time of the solenoid 28 is when the trailing end of the sheet P is clamped by the rollers 23 and 25. Upon clamping of the sheet P by the rollers 23 and 25, the sheet P is conveyed in the path 19 and then discharged by the rollers 20 into the tray 29.

When the above operation is repeated, the image formation surfaces of the sheets P face down on the tray 29 while the images are formed on the upper surfaces of the sheets P. Therefore, the order of the copied sheets is the same as that of the documents.

Since the plate 26 is pivoted downward while the sheet P is inverted by the mechanism A and fed by the rollers 23 and 25, the next sheet P can be fed by the rollers 23 and 25 into the subtray 30.

A multicopying mode wherein each of a plurality of documents is copied 10 times will be described. In the multicopying mode, the sheets P are discharged in the tray 29 in the same manner as described above. However, in this case, every time 10 copied sheets are stacked, a drive signal is supplied from the section 66 to the driver 70 which energizes the solenoid 53 and then the clutch 39 before the next document is subjected to copying. Power of the motor 49 is transmitted to the pin 38 through the gears 48 and 47, the shaft 46 and the clutch 39, so that the pin 38 is eccentrically rotated. Upon eccentric rotation of the pin 38, the rod 37 is moved and the link 34 is pivoted as indicated by the alternate long and two short dotted lines in FIG. 4. The slider 31 is moved by a distance l along a lateral direction (i.e., a direction perpendicular to the discharge direction of the sheet P), so that the stacking position of the sheets P corresponding to the next document can be varied.

Thereafter, when 10 copied sheets for the second document are discharged and stacked in the same manner as described above, they are stacked on the sheets P of the first document in an offset manner.

Subsequently, the tray 29 is moved to stack every 10 sheets corresponding to each document in an offset manner.

Figure 9:
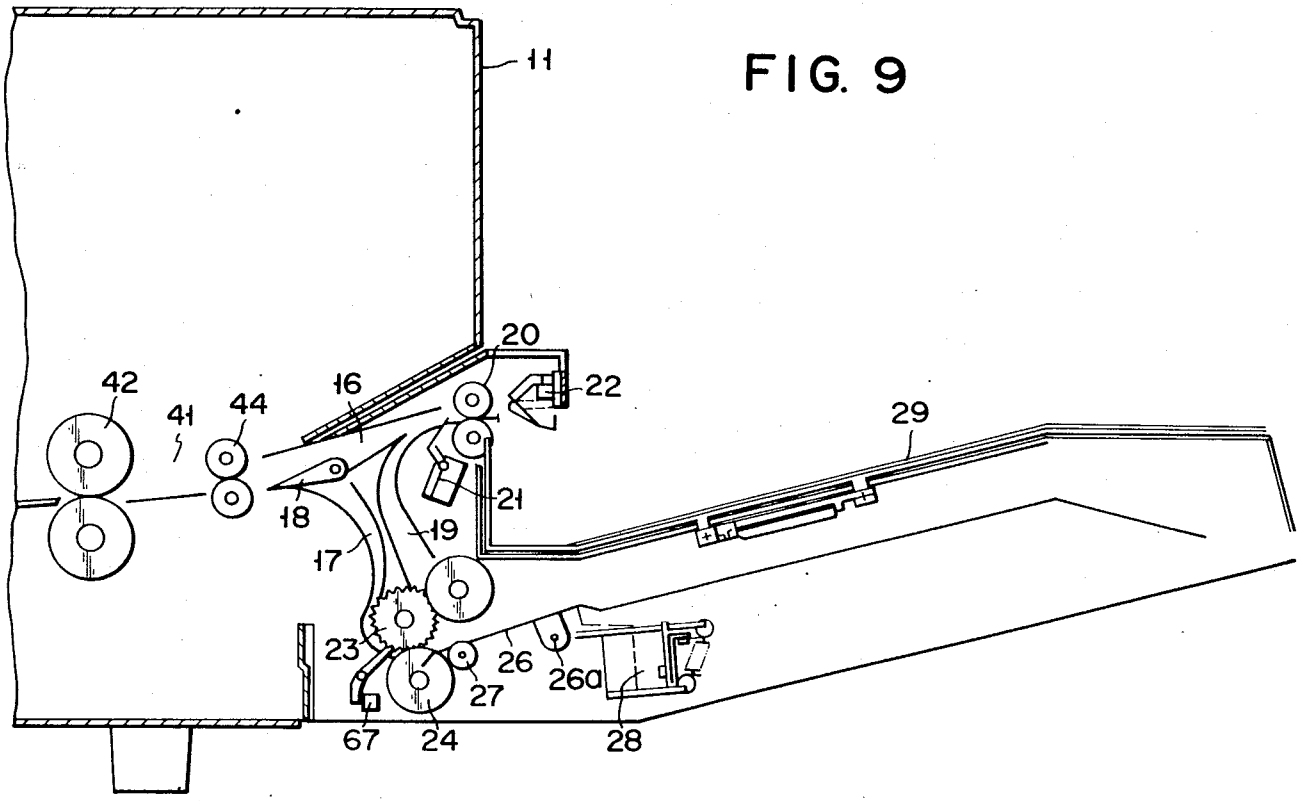

A case will be described wherein only one document is copied once. In this case, the section 66 supplies a signal to the driver 70 to deenergize the solenoid 78. As shown in FIG. 9, the lever 18 is pivoted downward, and the sheet P is not inverted and discharged by the rollers 20 along the path 16. The sheet P is discharged into the tray 29 such that the copied surface faces upward.

According to this embodiment, the mechanism A is provided for inverting the sheet P and guiding it into the tray 29. When a plurality of documents are continuously copied, the sheets are discharged in the tray such that their image formation surfaces face downward, so that the sheets have the same order as that of the documents.

In addition, since the mechanism B is provided for moving the position of the tray 29, the copied sheets can be grouped in units of documents when each of the plurality of documents is copied a plurality of times.

Furthermore, the tray 29 is detachably mounted on the slider 31. When paper jam occurs on the subtray 30, the tray 29 can be removed to take away the jammed sheet P.

Furthermore, since the vertical portion 29*a* of the tray 29 is integrally formed with the tray 29, the stacked sheets P can be properly aligned even if the tray 29 is moved.

Furthermore, since the roller 27 is integrally formed with the plate 26, the structure can be simplified and the proper operation can be performed.

Furthermore, the mechanism A is provided below the tray 29, so that the space can be effectively utilized and the copied sheets can be easily removed.

Furthermore, since the roller 23 has the grooves 23*a*, the sheet P can be easily fed.

Furthermore, the lever 18 is provided for discharging the sheets such that the image formation surfaces face upward as needed.

Furthermore, since a common drive source is used for the mechanisms A and B, the structure can be simplified and is low in cost.

Furthermore, the projections 33 of the tray 29 are engaged with the recesses 32 of the slider 31, so that the tray 29 can be attached to or removed from the slider 31 with a one-touch operation.

The present invention is not limited to the embodiment described above. Various changes and modifications can be made within the spirit and scope of the invention.

What is claimed is:

1. A recording apparatus which records information on a sheet-like recording medium having a first surface and a second surface opposing the first surface, comprising:

recording means for recording the information on the first surface while the first surface of the recording medium faces upward;

conveying means for conveying the recording medium having the information recorded by said recording means along a first convey path while the first surface faces upward;

switching means arranged to oppose a distal end of the first convey path and movable between a first position where the recording medium conveyed along the first convey path is guided in a second convey path and a second position where the recording medium is guided in a third convey path;

a temporary stacking tray, arranged to oppose a distal end of the second convey path, for temporarily stacking the recording medium guided by said switching means from the first convey path to the second convey path while the first surface faces upward;

a stacking tray, arranged at a distal end of the third convey path, for stacking the recording medium guided along the third convey path; and inverting means for conveying the recording medium temporarily stacked on said temporary stacking tray to the third convey path through a fourth convey path without passing through said switching means while the the second surface faces upward, wherein said inverting means includes:

a drive roller;

a first driven roller in rolling contact with said drive roller, said first driven roller and said drive roller being provided with nip portions opposing the distal end of the second convey path; and a second driven roller in rolling contact with said drive roller, said second driven roller and said drive roller being provided with nip portions opposing the proximate end of the fourth convey path, wherein said temporary stacking tray has a plate which is movably arranged between a first position where the plate is located below the nip portions of said first driven roller and said drive roller when the recording medium is guided by said switching means along the second convey path and a second position where the recording medium on said plate is brought into tight contact with said second driven roller.

2. The apparatus according to claim 1, wherein said temporary stacking tray is arranged below said stacking tray.

3. The apparatus according to claim 1, wherein said inverting means comprises driving means for moving said plate between the first and second positions, said driving means being operated such that said plate is located in the second position when a predetermined period of time has elapsed after a trailing end of the recording medium passes through the nip portions of said first driven roller and said drive roller.

4. The apparatus according to claim 3, wherein said driving means temporarily holds said plate in the second position until the trailing end of the recording medium is clamped between the nip portions of said second driven roller and said drive roller and thereafter moves said plate to the first position.

5. The apparatus according to claim 1, wherein the nip portions of said second driven roller and said drive roller are located above those of said first driven roller and said drive roller.

6. The apparatus according to claim 1, wherein said stacking tray is movable along a direction within a plane thereof.

7. The apparatus according to claim 6, which further comprises variable means for moving said stacking tray in the direction along the plane thereof between a first position where said stacking tray receives the recording medium at a predetermined position and a second position different from the first position.

8. The apparatus according to claim 7, wherein said variable means comprises a drive source for driving said stacking tray, said inverting means comprises driving means for respectively driving said driving roller and first and second driven rollers, said driving means being provided with a common drive source.

9. The apparatus according to claim 7, wherein said variable means causes said stacking tray to move along a direction perpendicular to an extending direction of the third convey path.

10. The apparatus according to claim 1, which further comprises variable means for moving said stacking tray in a direction along a plane thereof between a first position where said stacking tray receives the recording medium at a predetermined position and a second position different from the first position.

11. The apparatus according to claim 10, wherein said variable means comprises a drive source for driving said stacking tray, said inverting means comprises driving means for respectively driving said drives roller and first and second driven rollers, said driving means being provided with a common drive source.

12. The apparatus according to claim 10, wherein said variable means causes said stacking tray to move along a direction perpendicular to an extending direction of the third convey path.

* * * * *